United States Patent [19]

Blaszkowski

[11] 4,309,014

[45] * Jan. 5, 1982

[54] SOAP BAR AND RELEASABLE HOLDER

[76] Inventor: Henry Blaszkowski, P.O. Box 114, Southfield, Mich. 48034

[ * ] Notice: The portion of the term of this patent subsequent to Dec. 11, 1996, has been disclaimed.

[21] Appl. No.: 185,220

[22] Filed: Sep. 8, 1980

Related U.S. Application Data

[63] Continuation-in-part of Ser. No. 45,293, Jun. 4, 1979, abandoned, which is a continuation of Ser. No. 884,768, Mar. 9, 1978, abandoned, which is a continuation-in-part of Ser. No. 585,706, Jun. 10, 1976, abandoned, which is a continuation-in-part of Ser. No. 392,817, Aug. 29, 1973, abandoned, which is a continuation-in-part of Ser. No. 274,641, Jul. 24, 1972, abandoned, which is a continuation-in-part of Ser. No. 93,000, Nov. 27, 1970, abandoned.

[51] Int. Cl.[3] ..... A45D 40/00; A47G 29/08; C11D 17/04

[52] U.S. Cl. ..... 248/359; 248/309 R; 252/90; 252/92; 252/134; 252/174; 252/DIG. 16; D28/8.1

[58] Field of Search ..... 252/92, 90, 134, 174; D73/1 A; 248/309 R, 309 A, 359, 360, 205 R, 304, 306; D28/8.1

[56] References Cited

U.S. PATENT DOCUMENTS

| | | | |
|---|---|---|---|
| 624,809 | 5/1899 | Howe | 248/309 A |
| 1,495,165 | 5/1924 | Cummins | 248/359 |
| 2,120,599 | 6/1938 | Brown | 248/359 |
| 2,586,626 | 2/1952 | Dunn | 248/309 A |
| 2,708,807 | 5/1955 | Smith | 248/359 |
| 2,717,472 | 9/1955 | Wilmington | 248/206 R |
| 2,825,177 | 3/1958 | Nordlof et al. | 248/359 X |
| 2,988,842 | 6/1961 | Seufert et al. | 248/359 |
| 3,100,363 | 8/1963 | Staver | 248/359 X |
| 3,125,824 | 3/1964 | Staver | 248/359 X |
| 3,169,743 | 2/1965 | Page | 248/206 A |
| 4,177,965 | 12/1979 | Blaszkowski | 252/92 X |

FOREIGN PATENT DOCUMENTS

| | | | |
|---|---|---|---|
| 83416 | 4/1920 | Austria | 252/92 |
| 12359 | of 1912 | United Kingdom | 252/92 |

*Primary Examiner*—Dennis L. Albrecht
*Attorney, Agent, or Firm*—Barnes, Kisselle, Raisch & Choate

[57] ABSTRACT

A soap bar and holder therefor wherein the soap bar has a centrally apertured plastic insert embedded therein and the holder has a rubber suction cup base for mounting on a suitable surface and a shank having a free end portion adapted to receive the plastic insert in the soap bar so as to support the soap bar with the shank in either a horizontal, inclined or upright position. The soap bar is adapted to be retained on the holder either loosely or in a stable condition so that one's hands may be rubbed over the soap bar while the bar remains on the holder and the bar may also be removed from the holder and used in the manner of a conventional bar of soap.

27 Claims, 8 Drawing Figures

SOAP BAR AND RELEASABLE HOLDER

This application is a continuation-in-part of my application Ser. No. 06/045,293, filed June 4, 1979, now abandoned; the latter being a continuation of prior application Ser. No. 884,768, filed Mar. 9, 1978, now abandoned; the latter application being a continuation-in-part of my prior application Ser. No. 585,706, filed June 10, 1976, now abandoned; the latter being a continuation-in-part of my prior application Ser. No. 392,817, filed Aug. 29, 1973, now abandoned; the latter being a continuation-in-part of my prior application Ser. No. 274,641, filed July 24, 1972, now abandoned; the latter being a continuation-in-part of my prior application Ser. No. 93,000, filed Nov. 27, 1970, now abandoned.

This invention relates to a soap bar and a holder therefor.

The use of conventional holders for a bar of soap usually presents the problem of retaining the soap in a readily accessible position in which it will not be adversely affected (such as by softening or becoming distorted or worn) by the surrounding water or the water draining thereform. Although it has been proposed to attach various types of devices such as cords, anchoring studs, etc. to soap bars, none of such devices has to my knowledge solved the aforementioned problems without presenting further problems, such as impairing the ease with which the soap bar can be used or engaged with the holder.

Accordingly, it is an object of the present invention to provide a soap bar having an insert firmly embedded therein which in no way interferes with the normal use of the bar and which enables the bar to be conveniently and readily engaged with a holder so as to retain the soap in a position ready for use and unaffected by the surrounding or draining water.

A further object of the invention is to provide a soap bar having a rigid insert therein which not only facilitates engagement of the soap bar with a holder but which also reinforces the soap bar without protruding from the soap bar as the latter becomes reduced in size through use.

Still another object of the invention is to provide a soap bar having a rigid insert embedded therein, the soap bar being shaped to present to the user's hands two opposed faces which are generally flat or slightly curvilinear with the insert being exposed only at one of said faces so that a cavity in the insert can be interengaged with a fixedly supported soap bar holder.

Another object of the invention is to provide a soap bar having an apertured insert therein and a holder adapted to be mounted on a flat supporting surface (either horizontal or vertical) and with which the insert can be readily and easily engaged to support the soap bar in a manner unaffected by surrounding water, such as would be true in a conventional soap dish.

A further object of the invention is to provide a soap bar having an apertured insert embedded therein and a holder adapted to be mounted on a supporting surface and with which the insert can be readily and easily engaged to either support the soap bar frictionally in a generally fixed position so as to enable the user to rub his hands thereover or in a position loosely retained by and readily removable from the holder to enable the user to manipulate the soap bar in a conventional manner.

Another object of the invention is to provide a soap bar with a rigid insert embedded therein designed so that the soap bar can be snapped into and out of engagement with a holder without applying excessive forces to the bonding area between the insert and soap bar.

One of the numerous advantages of the present invention resides in the fact that the same soap bar-holder combination can be used in or on a sink, on a counter, or on the wall of a shower. At the same time, the soap bar and holder are designed so that the soap bar can be engaged with the holder with utmost ease even if the user's hands or the soap bar are wet and slippery. This is especially important in a shower where visibility may be impaired by running water or soap or the absence of normally worn eyeglasses which may require interengagement of the soap bar with the holder to be accomplished almost subconsciously.

These and other objects, features and advantages of the present invention will become apparent from the following description and accompanying drawings, in which.

Figure 1:
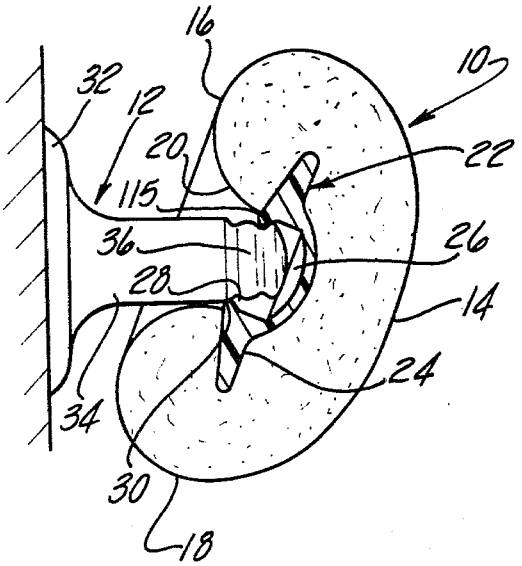
FIG. 1 is a side elevational view, partly in section, of one form of soap bar and holder according to the present invention, the soap bar being shown merely loosely suspended from the holder.

Referring first to FIG. 1, the arrangement shown therein comprises a bar of soap 10 and a holder 12. Soap bar 10 is molded or otherwise formed of generally circular shape as viewed in plan (perpendicular to the showing in FIG. 1) with a slightly curved outer face 14 connected to an opposed inner face 16 by a peripheral curved surface portion 18. The inner face 16 flares inwardly at the central portion thereof to form a recess 20. Within soap bar 10 there is arranged an insert 22 which is preferably formed of a rigid, but slightly yieldable, water insoluable material, such as plastic. Insert 22 is embedded within a socket 24 in soap bar 10. Insert 22 is preferably in the form of a relatively thin circular disc having a central cavity 26 open at one side thereof as at 28. Cavity 26 is of generally circular cross section in a plane parallel to the plane of opening 28 and is formed with a radially inwardly projecting edge 30 in the nature of a lip which defines the periphery of opening 28. The insert is located generally in the central plane of the soap bar between faces 14 and 16. It will be noted that the soap bar has a diameter substantially greater than its thickness (the dimension between faces 14 and 16).

Holder 12 is also preferably formed of plastic having a base 32, preferably in the form of a rubber suction cup, a shank 34 and a free end portion 36. The configuration of the holder shown in FIG. 2 is substantially the same as that shown in FIG. 1 and, since FIG. 2 is on an enlarged scale, the detailed configuration of the end portion 36 of holder 12 will be described in connection with FIG. 2.

Figure 2:
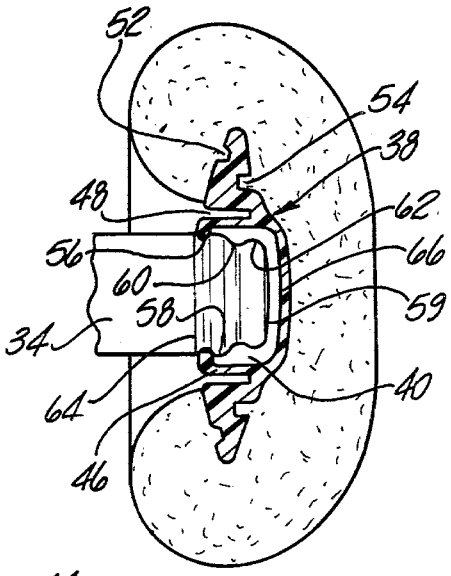
FIG. 2 is a sectional view, on an enlarged scale, showing a portion of the holder illustrated in FIG. 1 and showing the soap bar with a slightly modified insert firmly frictionally retained on the holder.
Figure 3:
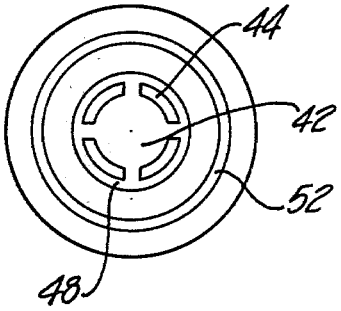
FIG. 3 is a plan view of the soap bar insert illustrated in FIG. 2.

The insert 38 shown in FIGS. 2 and 3 differs slightly from insert 22 shown in FIG. 1. Insert 38 is in the form of a thin circular disc formed with a central cavity 40 provided with a restricted opening 42 at one side thereof. Opening 42 is defined by four radially inwardly extending arcuate segments 44 (see FIG. 3) at the outer ends of cylindrical wall portions 46 which define cavity 40. Cylindrical wall portions 46 are rendered somewhat flexible in a direction radially of cavity 40 by reason of an annular groove 48 around the outer periphery of wall portions 46. As a practical matter it is not essential that wall portions 46 are flexible. Insert 38 is also provided with additional radially spaced circular grooves 52 and 54 on the opposite faces thereof to enhance its holding power within the soap bar.

In the embodiment illustrated in FIGS. 1 and 2 the configuration of the end portion 36 of the holder 12 is designed such that the soap bar can be snapped onto the end of the holder to retain it in a relatively fixed position (FIG. 2) or the soap bar can be merely freely suspended from the end of the holder as shown in FIG. 1. Thus, as more particularly shown in FIG. 2, shank 34 is formed with an annular groove 56, the base diameter of which is preferably about the same size as the diameter of opening 42. However, the base diameter of groove 56 may be slightly larger or slightly smaller than the diameter of opening 42 while still retaining the soap bar firmly on the holder. This firm retention results from the fact that groove 56 is defined in part by an annular hump 58 having an outer diameter greater than the diameter of opening 42 so that, if it is desired to interengage the radially inwardly turned lip portions 44 of the insert with groove 56, it is necessary to urge the soap bar inwardly towards the base of the holder with sufficient force to flex walls 46 outwardly and thereby enable the inwardly turned portions 44 of walls 46 to ride over the annular hump 58. This position of soap bar is shown in FIG. 2. Obviously a force of like magnitude is required to remove the soap bar from the holder.

The free end portion 36 of holder 12 is in the form of a head having a rounded free end face 59 which in combination with the flared recess 20 of the soap bar facilitates easy alignment and insertion of the end holder with the cavity to enable interengagement thereof. Portion 36 of holder 12 includes a second radially inwardly extending groove 60 having a base diameter substantially smaller than the diameter of opening 42. Groove 60 is defined on one side by annular hump 58 and on its opposite side by a slightly enlarged head 62, the outer diameter of which is larger than the base diameter of groove 60, but, nevertheless, smaller than the diameter of opening 42 of insert 38 and opening 28 of insert 22. Thus, if it is desired to merely freely suspend the soap bar on the holder so that it can be readily removed therefrom for use, the soap bar (and particularly the insert) is arranged on the holder in the position shown in FIG. 1. In this position the upper portion of lip 30 is seated in groove 60 at the top side of the holder and the soap bar assumes an inclined position with the lower portion of lip 30 engaging the shank 34 adjacent shoulder 64 to limit the angle of tilt and, thus, assure retention of the soap bar on the holder. The size relationship between opening 28 of insert 22 with holder 12 is the same in FIG. 1 as described above with reference to FIG. 2. In other words, with the embodiments illustrated in FIGS. 1 and 2 the soap bar can be arranged on the holder so that it is merely freely suspended thereon as shown in FIG. 1 or firmly frictionally retained thereon in the manner illustrated in FIG. 2. In either event, it will be appreciated that in the embodiments illustrated in FIGS. 1 and 2 one side of groove 56 is defined by a shoulder 64 which in effect limits the extent to which the free end of shank 34 can be inserted into the insert cavity. Shoulder 64 also facilitates automatic alignment of the insert in a plane perpendicular to the axis of the holder even though the soap bar is disposed in a somewhat cocked or inclined position when it is initially engaged with the end of the holder to snap it firmly thereon. After any portion of the edge of opening 42 abuts shoulder 64, the application of further force on the soap bar causes the insert to snap over hump 58 and automatically causes the insert to assume a position perpendicular to the axis of the holder. This, of course, depends upon the relative dimensions between the diameter of opening 42 and the axial distance between shoulder 64 and the large diameter free end portion 62 of the holder. The depth of the insert cavity is related to the diameter of the head of the holder so that at least the upper half of the holder head can be fully inserted into the cavity while the soap bar is inclined to the axis of the holder at a substantial angle so that the soap bar will remain suspended on the holder when released. It is, therefore, important from a practical standpoint to have a relatively small diameter opening in the insert since this dimension determines the minimum cavity depth. The cavity depth will in turn determine the thickness of the insert. For all practical purposes it is desirable to have an insert no thicker than necessary. For example, the soap bar preferably has a diameter of about 3¼ inches and a thickness of about 1½ inches; the insert diameter is about 1½ inches and the diameter of opening 42 is less than one-half the diameter of the insert and preferably on the order of about 9/16 inches. Obviously the center of gravity of the soap bar with the insert embedded therein lies between the opposed faces of the soap bar in a plane parallel to the plane of the insert and located slightly to the right of the central plane of the soap bar as viewed in FIGS. 1 and 2. This is true of all forms of soap bars shown and described herein.

If shoulder 64 is not employed, annular hump 58 can be so located with respect to the depth of cavity 40 so that the free end 36 of the holder will abut the inner end wall 66 of cavity 40 when the soap bar is pushed onto the holder sufficiently such that the inwardly turned edges 44 ride over hump 58 to firmly and frictionally retain the soap bar on the holder. However, if shoulder 64 is eliminated, more accurate initial alignment of the insert and holder is required to snap the insert into proper frictional engagement with the holder.

With the soap bar frictionally and firmly retained on the holder it may be used by simply rubbing the hands over the surface thereof. It will be appreciated that, while FIGS. 1 and 2 show the holder mounted on a vertical surface, the soap bar can be supported on the holder in the same manner as described when the holder is mounted on a horizontal or an inclined surface. When holder 12 is mounted in an upright position on a horizontal surface the soap bar is adapted to be loosely supported thereon in the manner illustrated in FIG. 1 while still enabling the user to rub his hands thereover without disengaging it from the holder. In this case, while the soap will be movable on the upper end of the holder, shoulder 64 will engage lip 30 to prevent the soap bar from tilting excessively and from being unintentionally disengaged from the holder.

It will be appreciated that the annular inwardly flared portion 20 of the inner face 16 of the soap bar has a diameter where it intersects the insert at least slightly greater than the diameter of the shank of the holder so that the holder itself will not touch the soap bar itself but rather will be engaged with the plastic insert. The restricted access opening in the case of the soap bar shown in FIG. 1 is that opening which is designated 28 and defined by the annular lip 30 and in the case of the soap bar shown in FIG. 2 the restricted access opening is that opening which is designated 42 and defined by the inwardly turned segments 44 of the side wall portions 46.

Aside from the fact that the construction shown in FIGS. 1 and 2 enables the soap bar to be either merely freely suspended from the holder or to be frictionally retained thereon by shoulder 58, this construction embodies other features which are deemed important. Since the insert is located generally at the central portion of the soap bar and is exposed only at one face of the bar, the soap bar can be substantially completely used before the insert is substantially exposed. This advantage also results from the fact that the insert is of generally tapered cross section so that it is progressively thinner from the center to the outer peripheral edge which more or less conforms to the manner in which a conventional soap bar wears as it is consumed through use. In addition, the faces 14 and 16 present generally flat surfaces to the palms of the hands when the soap is being used, thus providing a more efficient washing action and a more convenient method of manipulating the soap bar as distinguished from a soap bar of generally spherical shape. Furthermore, in view of the fact that the restricted access opening in the insert is relatively small in comparison to the diameter of the insert and, more particularly, in comparison to the outer diameter of the soap bar, it is a relatively easy matter to axially align the opening of the insert with the free end of the holder. The relatively small size of the access opening also renders its presence substantially unperceptible when the soap bar is consumed to the extent that the insert is exposed and is rubbed between the user's hands or over the user's body. A relatively large access opening would produce an objectionable and annoying sensation when used in this manner.

Figure 4:
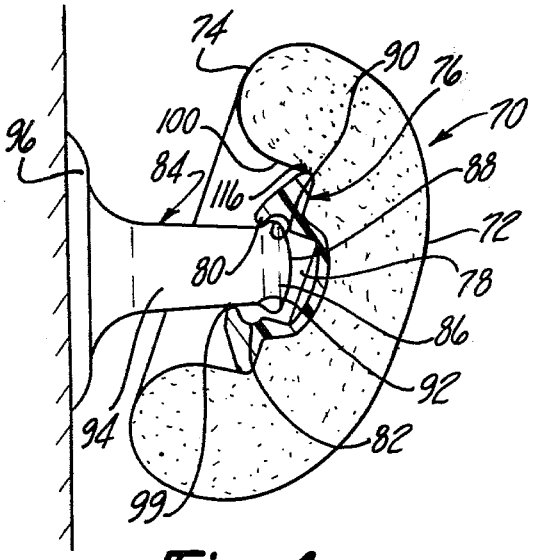
FIG. 4 is a side elevational view, partly in section, of a modified form of holder, insert and soap bar, the soap bar being loosely supported on the holder.
Figure 5:
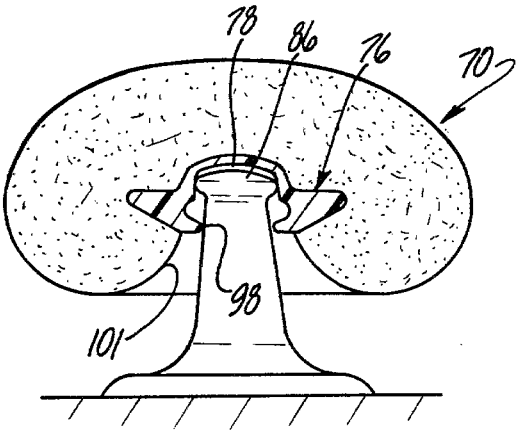
FIG. 5 is a side elevational view, partly in section, showing a slightly modified form of soap bar arranged in a stable position on the holder shown in FIG. 4.

FIGS. 4 and 5 illustrate a further form of combination soap bar-holder according to the present invention. In this modification, the soap bar is adapted to be loosely retained on the holder or supported on the holder in a stable position with or without providing an interference fit between the head of the holder and the cavity in the insert. As in the previous embodiments illustrated, the soap bar itself, generally designated 70, has a pair of opposed faces 72,74 and is proportioned so that its lateral dimension is substantially greater than its thickness. The insert 76 has an inner cylindrical cavity 78 therein and the opening thereof is defined by a radially inwardly extending circumferential lip 80. Directly adjacent lip 80 the insert is formed with a radially outwardly extending annular groove 82. Preferably the diameter of the inner cylindrical cavity 78 is about the same as or slightly larger than the diameter of the opening defined by lip 80.

The holder illustrated in FIGS. 4 and 5 is generally designated 84 and, as in the case of the previous holder described, is formed with a head 86 at the free end thereof. Head 86 is of circular cross section in a direction perpendicular to the axis of the holder and the free end portion thereof comprises a curved end portion 88. The axially intermediate portion of head 86 comprises a radially enlarged section, the outer periphery of which has a rounded contour 90 which at one side merges smoothly with the curved free end portion 88 and which at its opposite side curves inwardly to form a smaller diameter rounded shoulder 92 at its intersection with the shank 90 of the holder. The maximum diameter of the rounded portion 90 is preferably about the same as or slightly larger than the diameter of the opening defined by lip 80 to produce a slight interference sensation during their interengagement. Holder 84 may be formed of rubber with a suction cup base 96. The shank 94 of the holder can be cylindrical or slightly tapered. However, the shank is dimensioned so that, when the soap bar is substantially fully inserted over the head 86 of the holder, lip 80 engages or is at least closely adjacent the shank as at 98.

With the above described arrangement the soap bar can be loosely supported on the holder by simply telescoping insert 76 only partially over the head 86 of the holder. The position the soap bar assumes when used in this manner and when the holder 74 is mounted on a vertical surface is illustrated in FIG. 4. The largest diameter of head 86 is about the same or only slightly less than the diameter of the inner cylindrical insert cavity 78. When the soap bar is loosely supported on the holder the lip 80 of the insert engages the smaller diameter rounded shoulder 92 at the top of the holder and engages the shank 94 at the bottom of the holder as at 99 so as to limit the angle of tilt of the soap bar in the manner illustrated in FIG. 1.

The close or slight interference fit between lip 80 and the head of the holder effectively prevents the soap bar from being unintentionally dislodged from the holder as might happen when the soap bar is accidentally bumped while suspended vertically from the wall of a shower, for example. When using the soap in a shower the user would normally repeatedly hang the soap bar on the holder in the freely suspended position since it might be rather annoying to continually snap the soap bar onto and off of the holder. A slightly enlarged head on the holder which produces a slight interference fit with the opening in the insert provides several important functions in this connection. Since the soap bars as disclosed herein are not symmetrical about the axial central plane thereof, it follows that when they are freely suspended from the holders as shown in FIGS. 1 and 4 they tend to assume a position inclined to the holder because the soap is top heavy. Even when so inclined the slight interference fit prevents the soap from falling off the holder when it is accidentally bumped. The slight interference fit requires only a minimum of effort to suspend the soap bar on the end of the holder as distinguished from the effort required to snap it into firm engagement with the holder. However, the slight resistance is subconsciously detected by the user when suspending the soap bar on the holder so that the user becomes definitely aware of the fact that the soap bar is secured on the holder in a freely suspended position and, accordingly, after experiencing this slight resistance, the user can release the soap with confidence that it will not fall off of the holder.

The soap bar can also be fully telescoped over the head of the holder to the position shown in FIG. 5 in which event the soap bar will be supported on the holder in a stable position even though it may rotate thereon during use to facilitate uniform wear. This is true regardless of whether the holder is mounted on a horizontal surface as shown in FIG. 5 or a vertical surface as shown in FIG. 4. In either case the soap bar will be retained on the holder when the user rubs his hands thereover.

The enlarged head 86 at the end of shank 94 serves the useful purpose of enabling the soap bar to be merely loosely hung on the holder, for example, in a shower. This is readily accomplished even with a slight interference fit between lip 80 and the rounded periphery 90 of head 68. The rounded head 68 in combination with lip 80 enables the soap bar to be readily engaged with the holder even if the soap bar is being directed against the head of the holder at a substantial angle as shown in FIG. 4. A very shallow insertion assures proper suspending interengagement between the soap bar and holder. The arrangement shown in FIG. 5 is preferred when it is desired to retain the soap bar on the holder during use as by rubbing the hands thereover.

The soap bar shown in FIG. 4 differs from that shown in FIG. 5 in that the recess 100 extends inwardly to the outer periphery of insert 76 and the recess 101 on the soap bar shown in FIG. 5 tapers inwardly to the face portion of the insert surrounding lip 80 in the manner illustrated in FIGS. 1 and 2. With the arrangement shown in FIG. 4 the insert can be pressed into a conforming socket in the soap bar. With the arrangement shown in FIG. 5 the soap bar is molded around the insert. While the arrangement shown in FIG. 5 is preferred, it will be understood that the soap bar shown in FIGS. 1 and 6 can be formed as shown in FIG. 4.

Figure 6:
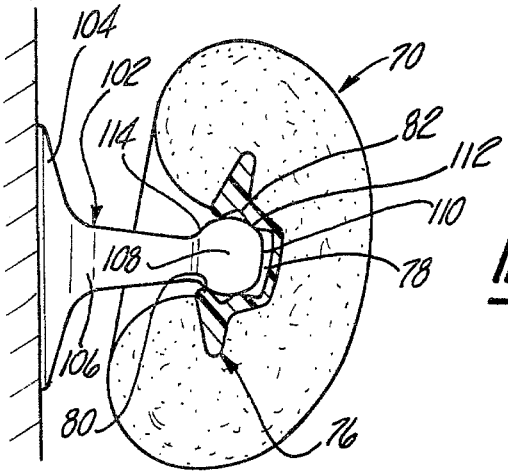
FIG. 6 is a side elevational view of a further modified form of soap bar-holder arrangement, the insert being the same as that shown in FIGS. 4 and 5.
Figure 7:
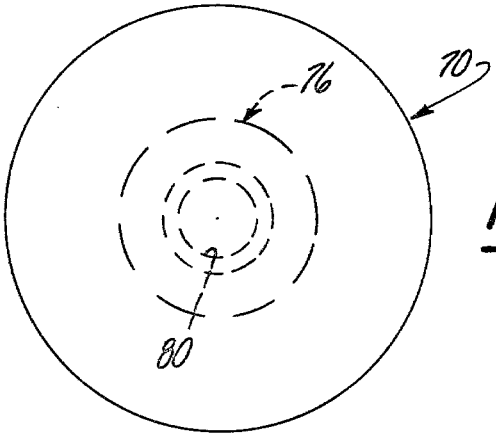
FIG. 7 is a top view of the soap bar shown in FIG. 6.

The soap bar and insert shown in FIG. 6 is substantially the same as that shown in FIG. 5. The holder illustrated in FIG. 6, which is generally designated 102, has a suction cup base 104, a shank 106 and a head 108 at the free end thereof which is of generally spherical shape and may have a flat free end portion 110. Holder 102 is preferably formed of rubber. The diameter of head 108 is only slightly larger than the diameter of lip 80 and the diameter of the inner cylindrical insert cavity 78. With this arrangement there is a slight interference fit between the head 108 of the holder and lip 80 on the insert. Thus, the insert can be snapped over head 108 with very little effort and, at the same time, even though the soap bar is inclined at a substantial angle relative to the axis of the holder, as distinguished from being perpendicular thereto. The shoulder 112 defined by the junction between groove 82 and cylindrical cavity 78 limits the extent to which the insert can be readily snapped over the head of the holder. Thus, in the arrangement shown in FIG. 6 the soap bar is adapted to be easily mounted on the holder and swivelly and frictionally supported thereon. In order to obtain this action it is only necessary to have the diameter of head 108 slightly larger than the diameter of the opening formed by lip 108 and shoulder 112 if either are made from a slightly yieldable material such as plastic. If head 108 is made of easily compressible rubber, the interference can be substantially greater.

It will be understood that the axial distance between the plane of opening defined by lip 80 and the plane of shoulder 112 which limits the depth of insertion of head 108 is such that lip 80 and shoulder 112 contact, frictionally engage and compress head 108 around two opposing ring-shaped portions of the head. The contact area is therefore substantially smaller than the total area of the spherically shaped surface portion of the head. Thus, a relatively high unit pressure is obtainable with even a slight interference fit. This results in the desired degree of friction between head 108 and the insert which, in view of the fact that the center of gravity of the soap bar and insert and the center of head 108 are both located between the opposite faces of the soap bar, insures the soap bar will be frictionally retained on the holder in any desired tilted position. From the standpoint of requiring a relatively small insertion and removal force while obtaining substantial frictional engagement between the soap bar and the holder, it is desirable that the lip of the insert engages the spherical head of the holder in a plane close to the major diameter of the head. It is preferred that the radial distance between the ring of engagement and the parallel plane through the center of the spherical head is not more than about 25% of the major diameter of the head. Thus, if head 108 has a diameter of ½ inch, then the line of engagement should be spaced radially from the center of the head a distance not more than about ⅛ inch.

As will be apparent from FIG. 6, the curved shoulder 114 between shank 106 and the spherical head 108 prevents the soap bar from tilting to an extent that the upper portion of lip 80 can ride over the major diameter of the head in a plane perpendicular to the axis of the holder shank and onto the flattened end 110 which would permit the soap bar to fall off of the holder. Thus, the entire head need not be of spherical shap and the insert can be thinner than if the entire head were spherical.

A feature common to each soap bar disclosed is the fact that the insert is recessed into one face of the soap bar, thus enabling the soap bar to be used over an extended period of time without annoying or uncomfortable interference from an insert projecting from the surface of the bar when the soap bar is rubbed between the hands or against the user's body. It will be noted that the soap bars disclosed have a lateral dimension greater than their thickness so as to present two opposed faces which are primarily rubbed against the user's hands or body. These faces are disposed on opposite sides of the insert and can be slightly rounded as shown. As a result, the soap bar will tend to retain its generally flat shape as it diminishes in size and, thus, the user can unconsciously orient the soap bar to properly interengage the soap bar and holder.

It will be observed that in all the embodiments the insert is not only recessed into the soap bar but also has a lateral dimension greater than its thickness and substantially less than the lateral dimension of the soap bar. This lateral dimension of the insert lies in a plane generally parallel to the plane of the lateral dimension of the soap bar itself. Thus, by recessing the insert into the much larger soap bar, the exposed line of junction between the insert and the soap is spaced considerably from the outer periphery of the soap bar in a plane parallel to the plane of the opening in the insert. In FIG. 1 this line of junction is designated 115 and in FIG. 4 this line junction is designated 116. In soap bars of the type illustrated in FIG. 1 one face of the insert is completely embedded in the soap bar and the opposite face thereof is only partially embedded in the soap bar. In the embodiment illustrated in FIG. 4 one face of the insert is completely exposed through the open end of recess 98. Nevertheless, in both types of soap bars the inserts are recessed substantially into the bar. Thus, in view of the shape of the soap bar and the shape of the insert, the soap bar can be used to a point where the soap has been consumed such that both of the opposed faces of the insert are substantially completely exposed.

It will be appreciated that with respect to the embodiments shown in FIGS. 1 and 2, regardless of whether the holder extends horizontally, vertically or in an inclined direction, the provision of an enlarged head at the end of the holder in combination with the restricted opening in the insert enables the soap bar to be used by merely suspending or freely supporting it on the holder so that the soap bar can remain engaged with the holder even though loosely retained thereby and the hands rubbed thereover. In the latter condition the soap bar may wobble on the holder, but the interengagement of the restricted opening in the insert with the enlarged head on the holder will prevent the soap bar from falling off of the holder. In other words, the soap bar-holder combination disclosed herein is capable of being used in three different modes; namely: in the manner illustrated in FIGS. 2, 5 and 6 where the soap bar is retained on the holder in a stable condition and the hands rubbed thereover; or where the soap bar is removed from the holder and used in the conventional manner; or the soap bar may be loosely engaged with the holder and used in the manner described with reference to FIG. 1. Where the soap bar is used in the conventional manner it can be repeatedly replaced on the holder in the freely suspended position (as in a shower) as in FIGS. 1 and 4 or it can be engaged therewith in a stable manner when used for washing one's hands (as in a conventional sink) as in FIGS. 2, 5 and 6.

An important feature of the soap bar disclosed herein resides in the fact that the access opening of the insert is in all cases relatively small as compared to the size of the insert and the size of the soap bar. In each embodiment the access opening in the insert is so small as to be virtually unnoticeable to the feel of the hands or body when contacted therewith. This feature is enhanced by the fact that the edges of the access opening are curved in cross section and the outer surfaces of the insert are generally smooth so as to present a comfortable feeling to the hands or body if any portion of the insert becomes exposed through use of the soap.

Likewise, with a relatively small access opening the frictionally engaging surfaces of the insert and holder are of relatively small extent so that positive retention of the soap on the holder and ready removal therefrom can be achieved with relatively little force. Furthermore, since the engagement and disengagement forces are concentrated at the central portion of the holder, the tendency for the insert to become dislodged from the soap bar is minimized. In this connection it will be noted that, although the insert is relatively thin, the bonding area between the soap bar and insert at the portion thereof radially outwardly of the access opening (even neglecting the concentric grooves in the insert) is substantially greater than the bonding area between the soap and the projected area of the opening on the back side of the insert. This area ratio to assure a good bond, especially where the insert is bonded to the soap at only one face thereof (FIG. 4), should be at least about 2:1.

Figure 8:
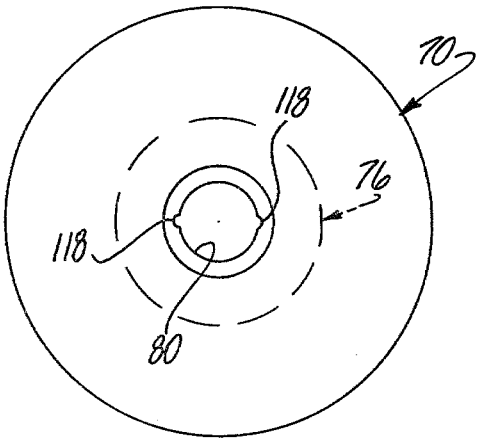
FIG. 8 is a bottom plan view of the soap bar shown in FIG. 6.

It will also be noted that the various insert configurations are adapted to engage all of the various holders illustrated and described. Thus, the user has the option of using the holder he prefers with any of the soap bars. For example, the type of insert shown in FIGS. 4, 5 and 6 can be used with the holders shown and described in connection with FIGS. 1 and 2. Lip 80 will then serve the purpose of either hanging or snapping the bar on the holder. When lip 80 is snapped over a slightly larger shoulder or head as previously described, the soap bar is firmly retained on the holder against accidental removal, but may still rotate or turn on the holder during use to facilitate uniform wear. Where necessary to permit the ingress or escape of air from the insert cavity, when the soap bar is engaged or disengaged from the head of the holder the lip of any of the inserts can be formed with one or more small notches 218 as shown in FIG. 8.

As shown in the drawings, the insert is preferably one in which the face thereof containing the cavity opening tapers inwardly of the soap bar in a radially outward direction. With such configuration a maximum bonding effect and a maximum life of the soap bar without obstruction from the insert is obtained when the insert is embedded such that the soap extends around the peripheral edge of the insert and over a portion of said tapered face. In any event, this configuration provides a smooth surface of the user's hands and body when the soap is practically all consumed even though the one face of the insert is not partially embedded in the soap bar. It follows, of course, that, even though the insert is not covered with soap on one side, the greater the amount of soap on the other side of the insert, the longer the bar can be used without obstruction by the exposed insert. Preferably, the soap bar should extend beyond the periphery of the insert a distance no less than about one-third the thickness of the soap at the completely embedded face of the insert.

I claim:

1. In combination a soap bar having a pair of opposed faces and having a socket therein extending inwardly from one of said opposed faces toward the other, an insert formed of a water-insoluable material embedded in said socket, said insert being in the shape of a generally circular disc having a pair of opposed faces of substantially the same diameter, one of said faces of the insert being completely embedded in and surrounded by the soap and the other being partially embedded in and surrounded by the soap bar and having at least the central portion thereof recessed into and exposed through the open end of said socket, said opposed faces of the insert having a substantially greater diameter than the dimension of the insert between and in a direction perpendicular to said opposed faces thereof, said insert having a cavity therein, a generally circular opening at the central portion of the exposed face of the insert which is relatively small in comparison with the diameter of the opposed faces of the insert, said opening communicating with said cavity, said cavity being otherwise substantially closed, said cavity being concentric to a central axis thereof which is perpendicular to the plane of said opening and which passes through the center of said opening, said cavity being of generally circular cross section in a plane perpendicular to said central axis, said opening being defined by a circumferential lip on said insert which extends radially inwardly of the cavity at the outer end thereof, the portion of the cavity directly behind said lip having a diameter larger than the diameter of said opening and a holder for said soap bar having a shank provided with a base at one end, said base having a mounting face for mounting the holder on a support surface, said shank having a central axis perpendicular to said mounting face so as to extend perpendicular to the support surface on which the holder is mounted, the opposite end of said shank terminating in a head concentric with the central axis of the shank, the outermost peripheral portions of said head in a plane perpendicular to the central axis of the shank lying on a circle which is concentric to said central axis of said shank and having a diameter smaller than the lateral dimension of said base in a plane perpendicular to said central axis, said head having a free end portion and a second portion axially adjacent the free end portion on the side thereof adjacent the shank, said second portion of the head having a smaller diameter than the largest diameter of the free end portion in a plane perpendicular to the central axis of the shank, said free end portion of the head being insertable through said opening in the insert for interengaging said lip with said second portion of said head to thereby retain the soap bar on the holder, the axial dimension of said cavity between said lip and the inner end of the cavity being substantially greater than the axial dimension between said second portion of the head and the axially outermost portion of said head, the maximum diameter of the free end portion of said head being smaller than the diameter of the portion of the cavity directly behind said lip, there being sufficient clearance between the head and cavity to permit the insert to assume a tilted position wherein the central axis of the cavity is inclined to the central axis of the shank when said lip is engaged with said second portion of the head, whereby the insert may be telescoped over the free end portion of said head with the central axis of said cavity inclined to the central axis of said shank so as to interengage a circular segment of the lip with a circular segment of the second portion of the head while the diametrically opposite segment of the lip is disposed more remote from the free end portion of the head thus enabling the soap bar to assume said tilted position relative to the central axis of the shank.

2. The combination set forth in claim 1 wherein said free end portion of said head has a maximum diameter in a plane perpendicular to the central axis of the shank which is at least equal to the diameter of the opening defined by said lip.

3. The combination set forth in claim 2 wherein the diameter of said opening is less than one-half the diameter of said opposited faces of the insert.

4. The combination set forth in claim 1 wherein the free end of said head has a maximum diameter in a plane perpendicular to the central axis of the shank which is less than the diameter of the opening defined by said lip.

5. The combination set forth in claim 1 wherein said soap bar has its center of gravity disposed such that, when the holder is mounted on a generally vertically disposed support surface with the central axis of the shank extending horizontally and the soap bar supported on the holder with the uppermost portion of the lip engaging the top side of the second portion of the head, the soap bar is gravitationally suspended on the holder in a tilted position wherein the central axis of the cavity is inclined upwardly toward said support surface and removal of the soap bar from the holder requires it is to be displaced upwardly to a position wherein the upper portion of the lip clears the top of the free end portion of said head.

6. The combination set forth in claim 1 wherein said head includes a third portion axially adjacent the second portion on the side thereof opposite the free end portion, said third portion having a diameter in a plane perpendicular to the central axis of the shank which is at least slightly greater than the diameter of said opening and over which said lip is adapted to be forced to firmly retain the soap bar on the holder whereby the soap bar can be retained either loosely or firmly on the holder when the holder is mounted on either a vertical or a horizontal support surface.

7. The combination set forth in claim 5 wherein the face of the insert provided with said opening is surrounded by the soap bar except for an annular portion thereof extending circumferentially around said lip, said socket in the soap bar being generally circular in a plane perpendicular to the central axis of the insert cavity and tapering radially inwardly from said one face of the soap bar to its junction with said annular face portion such that, when the holder is mounted on a vertical support surface and the soap bar is supported on the holder in said tilted position with the central axis of the cavity inclined upwardly toward the vertical support surface, the lower portion of the tapered socket inclines downwardly toward the vertical support surface.

8. The combination set forth in claim 1 wherein the length of said holder measured along the axis of said shank is such that, when the head of the holder is fully inserted in said cavity, said one face of the soap bar is spaced from said base a distance sufficient to enable one's fingers to extend therebetween.

9. In combination a soap bar having a pair of opposed faces and having a socket therein extending inwardly from one of said opposed faces toward the other, an insert formed of a water-insoluble material embedded in said socket, said insert being in the shape of a generally circular disc having a pair of opposed faces of substantially the same diameter, said opposed faces of the insert each being spaced inwardly of the opposed faces of said soap bar, one of said faces of the insert being completely embedded in and surrounded by the soap and the other being partially embedded in and surrounded by the soap bar and having at least the central portion thereof recessed into and exposed through the open end of said socket, said opposed faces of the insert having a substantially greater diameter than the dimension of the insert between and in a direction perpendicular to said opposed faces thereof, said insert having a cavity therein disposed generally centrally between said opposed faces of the insert, said insert having a generally circular opening at the central portion of the exposed face of the insert, said opening having a diameter less than one-half the diameter of the opposed faces of the insert, said opening communicating with said cavity, said cavity being otherwise substantially closed and being concentric to the central axis thereof which is perpendicular to the plane of said opening and which passes through the center of said opening, said cavity being of generally circular cross section in a plane perpendicular to said central axis, said opening being defined by a circumferential lip on said insert which extends radially inwardly of the cavity at the outer end thereof, said circumferential lip comprising at least in part said exposed central portion of said insert, the portion of the cavity directly behind said lip having a diameter larger than the diameter of said opening and a holder for said soap bar having a shank provided with a base at one end, said base having a mounting face for mounting the holder on a support surface, said shank having a central axis perpendicular to said mounting face so as to extend perpendicular to the support surface on which the holder is mounted, the opposite end of said shank terminating in a generally spherically-shaped head concentric with the central axis of the shank, said head having a diameter larger than the diameter of said opening, one of said insert and head being formed of a resiliently yieldable material for enabling the head to be inserted through said opening into said cavity for swivelly supporting the soap bar on the insert, said cavity and opening being dimensioned relative to said head such that when the head is disposed within the cavity the head and lip are resiliently, and thereby frictionally, interengaged in a plane spaced radially from the center of the head a distance not more than about one-quarter of the diameter of said head, the center of gravity of the soap bar with the insert embedded therein and the center of said head when inserted in the cavity both being located between the opposed faces of the soap bar so that the soap bar assumes any position on the holder to which it is swiveled by reason of its frictional engagement with the head.

10. The combination set forth in claim 9 wherein said cavity has a portion directly behind said lip which has a diameter in a plane perpendicular to the central axis of the cavity which is substantially larger than the diameter of the head and means in said cavity spaced axially inwardly of said enlarged portion thereof for limiting the extent to which the head can be inserted into the cavity and thereby caused said lip to frictionally grip the surface of the head for maintaining the soap bar in said swiveled position.

11. The combination set forth in claim 10 wherein said limiting means comprises an annular shoulder in the cavity concentric with and lying in a plane generally perpendicular to the central axis of the cavity.

12. The combination set forth in claim 10 wherein the diameters of said opening and said annular shoulder are substantially equal.

13. In combination a soap bar having a pair of opposed faces and having a socket therein extending inwardly from one of said opposed faces toward the other, an insert formed of a water-insoluable material embedded in said socket, said insert being in the shape of a generally circular disc having a pair of opposed faces of substantially the same diameter, one of said faces of the insert being completely embedded in and surrounded by the soap and the other being partially embedded in and surrounded by the soap bar and having at least the central portion thereof recessed into and exposed through the open end of said socket, said opposed faces of the insert having a substantially greater diameter than the dimension of the insert between and in a direction perpendicular to said opposed faces thereof, said insert having a cavity therein, a generally circular opening at the central portion of the exposed face of the insert which is relatively small in comparison with the diameter of the opposed faces of the insert, said opening communicating with said cavity, said cavity being otherwise substantially closed, said cavity being concentric to the central axis thereof which is perpendicular to the plane of said opening and which passes through the center of said opening, said cavity being of generally circular cross section in a plane perpendicular to said central axis, said opening being defined by a circumferential lip on said insert which extends radially inwardly of the cavity at the outer end thereof, the portion of the cavity directly behind said lip having a diameter larger than the diameter of said opening and a holder for said soap bar having a shank provided with a base at one end, said base having a mounting face for mounting the holder on a support surface, said shank having a central axis perpendicular to said mounting face so as to extend perpendicular to the support surface on which the holder is mounted, the opposite end of said shank terminating in a free end portion concentric with the central axis of said shank and dimensioned to be insertable into said cavity through said opening, said free end portion having a section of maximum diameter, the radially outer peripheral surfaces of said free end portion tapering radially inwardly toward said axis on axially opposite sides of said section of maximum diameter and forming on the side thereof adjacent said shank a circular section having a diameter smaller than said opening and smaller than said section of maximum diameter, said section of maximum diameter being smaller than the portion of the cavity behind said lip, said cavity being sized to loosely accommodate said free end portion with a circular segment of said lip engaging said smaller diameter section behind said section of maximum diameter, the axial depth of the cavity being such that when said free end portion is disposed within said cavity with said one segment of the lip engaged with the smaller diameter section of said free end portion, the soap bar can be freely tilted to a position where the diametrically opposite segment of the lip is located axially closer to the base end of the shank than said one segment of the lip so that engagement and disengagement between the soap bar and the holder can be accomplished while the plane of the opening is inclined to the axis of the shank at an angle other than perpendicular.

14. The combination set forth in claim 1 wherein said opposed faces of the insert incline toward each other in a radially outward direction.

15. The combination set forth in claim 1 wherein said dimension of the insert in a direction between said opposed faces is maximum at the central portion of the insert and is substantially less than said maximum at the outer circumferential edge portion of said insert.

16. The combination set forth in claim 15 wherein said outer circumferential edge portion of the insert lies in a plane perpendicular to the central axis of said cavity and intermediate the opposite face portions of the insert at the central portion thereof.

17. The combination set forth in claim 15 wherein said outer circumferential edge portion of the insert lies in a plane perpendicular to the central axis of said cavity and spaced axially inwardly from the plane of said opening.

18. The combination set forth in claim 15 wherein the insert is generally symmetrical about a mid plane perpendicular to the axis of said cavity.

19. The combination set forth in claim 15 wherein said insert tapers in thickness from its central portion to its outer circumferential edge portion.

20. The combination set forth in claim 13 wherein said opposed faces of the insert inclined toward each other in a radially outward direction.

21. The combination set forth in claim 13 wherein said dimension of the insert in a direction between said opposed faces is maximum at the central portion of the insert and is substantially less than said maximum at the outer circumferential edge portion of said insert.

22. The combination set forth in claim 21 wherein said outer circumferential edge portion of the insert lies in a plane perpendicular to the central axis of said cavity and spaced axially inwardly from the plane of said opening.

23. The combination set forth in claim 21 wherein said insert tapers in thickness from its central portion to its outer circumferential edge portion.

24. In combination a soap bar having a pair of opposed faces and having a socket therein extending inwardly from one of said opposed faces toward the other, an insert formed of a water-insoluable material embedded in said socket, said insert being in the shape of a generally circular disc having a pair of opposed faces of substantially the same diameter, one of said faces of the insert being completely embedded in and surrounded by the soap and the other being recessed into and having at least the central portion thereof exposed through the open end of said socket so that the insert as a whole is spaced inwardly of both of said opposed faces, said opposed faces of the insert having a substantially greater diameter than the dimension of the insert between and in a direction perpendicular to said opposed faces thereof, said insert having a cavity therein, a generally circular opening at the central portion of the exposed face of the insert which is relatively small in comparison with the diameter of the opposed faces of the insert, said opening communicating with said cavity, said cavity being otherwise substantially closed, said cavity being concentric to a central axis thereof which is perpendicular to the plane of said opening and which passes through the center of said opening, said cavity being of generally circular cross section in a plane perpendicular to said central axis, said opening being defined by a circumferential lip on said insert which extends radially inwardly of the cavity at the outer end thereof, the portion of the cavity directly behind said lip having a diameter larger than the diameter of said opening and a holder for said soap bar having a shank provided with a base at one end, said base having a mounting face for mounting the holder on a support surface, said shank having a central axis perpendicular to said mounting face so as to extend perpendicular to the support surface on which the holder is mounted, the opposite end of said shank terminating in a head concentric with the central axis of the shank, the outermost peripheral portions of said head in a plane perpendicular to the central axis of the shank lying on a circle which is concentric to said central axis of said shank and having a diameter smaller than the lateral dimension of said base in a plane perpendicular to said central axis, said head having a free end portion and a second portion axially adjacent the free end portion on the side thereof adjacent the shank, said second portion of the head having a smaller diameter than the largest diameter of the free end portion in a plane perpendicular to the central axis of the shank, said free end portion of the head being insertable through said opening in the insert for interengaging said lip with said second portion of said head to thereby retain the soap bar on the holder, the axial dimension of said cavity between said lip and the inner end of the cavity being substantially greater than the axial dimension between said second portion of the head and the axially outermost portion of said head, the maximum diameter of the free end portion of said head being smaller than the diameter of the portion of the cavity directly behind said lip, there being sufficient clearance between the head and cavity to permit the insert to assume a tilted position wherein the central axis of the cavity is inclined to the central axis of the shank when said lip is engaged with said second portion of the head, whereby the insert may be telescoped over the free end portion of said head with the central axis of said cavity inclined to the central axis of said shank so as to interengage a circular segment of the lip with a circular segment of the second portion of the head while the diametrically opposite segment of the lip is disposed more remote from the free end portion of the head thus enabling the soap bar to assume said tilted position relative to the central axis of the shank.

25. In combination a soap bar having a pair of opposed faces and having a socket therein extending inwardly from one of said opposed faces toward the other, an insert formed of a water-insoluable material embedded in said socket, said insert being in the shape of a generally circular disc having a pair of opposed faces of substantially the same diameter, said opposed faces of the insert each being spaced inwardly of the opposed faces of said soap bar, one of said faces of the insert being completely embedded in and surrounded by the soap and the other being recessed into and having at least the central portion thereof exposed through the open end of said socket, said opposed faces of the insert having a substantially greater diameter than the dimension of the insert between and in a direction perpendicular to said opposed faces thereof, said insert having a cavity therein disposed generally centrally between said opposed faces of the insert, said insert having a generally circular opening at the central portion of the exposed face of the insert, said opening having a diameter less than one-half the diameter of the opposed faces of the insert, said opening communicating with said cavity, said cavity being otherwise substantially closed and being concentric to the central axis thereof which is perpendicular to the plane of said opening and which passes through the center of said opening, said cavity being of generally circular cross section in a plane perpendicular to said central axis, said opening being defined by a circumferential lip on said insert which extends radially inwardly of the cavity at the outer end thereof, said circumferential lip comprising at least in part said exposed central portion of said insert, the portion of the cavity directly behind said lip having a diameter larger than the diameter of said opening and a holder for said soap bar having a shank provided with a base at one end, said base having a mounting face for mounting the holder on a support surface, said shank having a central axis perpendicular to said mounting face so as to extend perpendicular to the support surface on which the holder is mounted, the opposite end of said shank terminating in a generally spherically-shaped head concentric with the central axis of the shank, said head having a diameter larger than the diameter of said opening, one of said insert and head being formed of a resiliently yieldable material for enabling the head to be inserted through said opening into said cavity for swivelly supporting the soap bar on the insert, said cavity and opening being dimensioned relative to said head such that when the head is disposed within the cavity the head and lip are resiliently, and thereby frictionally, interengaged in a plane spaced radially from the center of the head a distance not more than about one-quarter of the diameter of said head, the center of gravity of the soap bar with the insert embedded therein and the center of said head when inserted in the cavity both being located between the opposed faces of the soap bar so that the soap bar assumes any position on the holder to which it is swiveled by reason of its frictional engagement with the head.

26. The combination set forth in claim 25 wherein said cavity has an annular shoulder therein concentric with the central axis of said cavity and having a diameter less than the diameter of the head, said shoulder being spaced axially inwardly from said lip, the portion of the cavity between said lip and shoulder having a diameter in a plane perpendicular to the central axis of the cavity which is larger than the diameter of the head, the axial spacing between said lip and shoulder being such that the shoulder limits the extent to which the head can be inserted into the cavity to a position wherein both the lip and shoulder engage opposed annular portions of the head with sufficient friction to retain the soap bar on the holder in any position to which it is swivelled.

27. In combination a soap bar having a pair of opposed faces and having a socket therein extending inwardly from one of said opposed faces toward the other, an insert formed of a water-insoluable material embedded in said socket, said insert being in the shape of a generally circular disc having a pair of opposed faces of substantially the same diameter, one of said faces of the insert being completely embedded in and surrounded by the soap and the other being recessed into and having at least the central portion thereof exposed through the open end of said socket so that the insert as a whole is spaced inwardly of both of said opposed faces, said opposed faces of the insert having a substantially greater diameter than the dimension of the insert between and in a direction perpendicular to said opposed faces thereof, said insert having a cavity therein, a generally circular opening at the central portion of the exposed face of the insert which is relatively small in comparison with the diameter of the opposed faces of the insert, said opening communicating with said cavity, said cavity being otherwise substantially closed, said cavity being concentric to the central axis thereof which is perpendicular to the plane of said opening and which passes through the center of said opening, said cavity being of generally circular cross section in a plane perpendicular to said central axis, said opening being defined by a circumferential lip on said insert which extends radially inwardly of the cavity at the outer end thereof, the portion of the cavity directly behind said lip having a diameter larger than the diameter of said opening and a holder for said soap bar having a shank provided with a base at one end, said base having a mounting face for mounting the holder on a support surface, said shank having a central axis perpendicular to said mounting face so as to extend perpendicular to the support surface on which the holder is mounted, the opposite end of said shank terminating in a free end portion concentric with the central axis of said shank and dimensioned to be insertable into said cavity through said opening, said free end portion having a section of maximum diameter, the radially outer peripheral surfaces of said free end portion tapering radially inwardly toward said axis on axially opposite sides of said section of maximum diameter and forming on the side thereof adjacent said shank a circular section having a diameter smaller than said opening and smaller than said section of maximum diameter, said section of maximum diameter being smaller than the portion of the cavity behind said lip, said cavity being sized to loosely accommodate said free end portion with a circular segment of said lip engaging said smaller diameter section behind said section of maximum diameter, the axial depth of the cavity being such that when said free end portion is disposed within said cavity with said one segment of the lip engaged with the smaller diameter section of said free end portion, the soap bar can be freely tilted to a position where the diametrically opposite segment of the lip is located axially closer to the base end of the shank than said one segment of the lip so that engagement and disengagement between the soap bar and the holder can be accomplished while the plane of the opening is inclined to the axis of the shank at an angle other than perpendicular.

* * * * *